US007832573B2

(12) United States Patent
Magnusson et al.

(10) Patent No.: US 7,832,573 B2
(45) Date of Patent: Nov. 16, 2010

(54) SELF-SUPPORTING SUSPENSION DEVICE AND METHOD FOR ASSEMBLING THEREOF

(75) Inventors: Reine Magnusson, Västervik (SE); Peter Nilsson, Västervik (SE); Jan Littorin, Edsbruk (SE); Joachim Wenström, Ankarsrum (SE)

(73) Assignee: Elfa International AB, Vastervik (SE)

( * ) Notice: Subject to any disclaimer, the term of this patent is extended or adjusted under 35 U.S.C. 154(b) by 698 days.

(21) Appl. No.: 11/707,888

(22) Filed: Feb. 20, 2007

(65) Prior Publication Data

US 2008/0116329 A1 May 22, 2008

Related U.S. Application Data

(60) Provisional application No. 60/859,263, filed on Nov. 16, 2006.

(51) Int. Cl.
*A47B 43/00* (2006.01)

(52) U.S. Cl. ..... 211/189; 211/191; 108/108; 108/157.13

(58) Field of Classification Search ..... 211/189, 211/195, 206, 192, 193, 175, 13.1, 204, 186, 211/191; 248/165, 166, 440, 440.1; 40/606.01, 40/607.1; 108/108, 109, 157.13
See application file for complete search history.

(56) References Cited

U.S. PATENT DOCUMENTS 2,787,382 A * 4/1957 Williams ..... 108/157.13
3,067,882 A * 12/1962 Ribbens et al. ..... 108/102
3,625,372 A * 12/1971 MacKenzie ..... 211/191
3,693,556 A 9/1972 Rous
5,433,327 A * 7/1995 Benvenuti et al. ..... 211/193
7,270,242 B2 * 9/2007 Liu ..... 211/189

FOREIGN PATENT DOCUMENTS

| | | |
|---|---|---|
| DE | 2846246 A1 | 4/1979 |
| FR | 1.171.105 | 1/1959 |
| FR | 2791741 | 10/2000 |
| GB | 2010663 A | 7/1979 |
| SE | 387829 | 9/1976 |

OTHER PUBLICATIONS

Ikea Markör, 2004-2005, Admitted Prior Art.
Electronic Pamphlet, Trähyllor, Admitted Prior Art.
DE 2846246 A1 corresponds with GB 2010663 A.
SE 387829 corresponds with US 3,693,556.

* cited by examiner

*Primary Examiner*—A. Joseph Wujciak, III
(74) *Attorney, Agent, or Firm*—Harness, Dickey & Pierce, P.L.C.

(57) ABSTRACT

A self-supporting suspension device may include vertically oriented columns. The columns may be releasably fastened to one or two feet by being inserted into slots of the respective feet and by surrounding a portion thereof. A stabilisation element may be fastened to two adjacent columns for lateral stability of the suspension device, and a locking beam or the stabilisation element may increase the torsional rigidity of the columns.

9 Claims, 8 Drawing Sheets

SELF-SUPPORTING SUSPENSION DEVICE AND METHOD FOR ASSEMBLING THEREOF

CROSS REFERENCE TO RELATED APPLICATIONS

This U.S. non-provisional application claims priority under 35 USC §119 to U.S. Provisional Application No. 60/859,263, filed Nov. 16, 2006, the content of which is incorporated herein in its entirety by reference.

BACKGROUND

1. Field of the Invention

The present invention relates to a self-supporting suspension device for suspending shelves, baskets or the like, with or without the aid of brackets, from at least two columns which in their raised position are substantially vertically oriented, a foot belonging to each column and being in the form of an elongate element which, when assembled to the associated column, is substantially at right angles to the longitudinal direction of the column, and a stabilisation element, which is adapted to be fastened to said columns to firmly interconnect them in a plane which is substantially at right angles to said feet.

The invention also relates to a method for assembling this self-supporting suspension device.

2. Description of Related Art

Mountable self-supporting sets of storage shelves are already known in a number of variants. They all have in common that they have factory-assembled end pieces and some kind of structure for lateral stabilisation of the set of shelves. Usually, metal profiles are used, such as flat bars, metal bars or thick metal wires, which are fastened diagonally in adjacent end pieces. Also scissor-like devices arranged for this purpose and fastened in similar manner are frequently used. Integral back pieces adapted to be nailed to adjacent end pieces have the same function. The different shelves rest on shelf carriers which are fastened to the columns of the end pieces. As a rule, a plurality of holes are bored in the columns, in which holes the shelf carriers are intended to be inserted. The shelf carriers have the form of pins, angle bars provided with pins, or wire straps.

Another type of self-supporting set of storage shelves has end pieces which consist of a pair of metal columns which are interconnected by screwed-on, crossed flat bars or the like, and in some sets of storage shelves they are stabilised by screwed-on shelves.

These self-supporting sets of storage shelves all have in common that they require a column in each corner of the shelves and that a plurality of pins and/or bolted joints are needed for the assembly of the sets of storage shelves. When assembled in upright position, they are also, in general, cumbersome and difficult to assemble. In addition, they are only intended for shelves and not for wire baskets, clothes racks, trouser hangers and the like.

SUMMARY

Example embodiments may provide a self-supporting suspension device, which is easy to assemble, which does not require any screwed or bolted joints or the like, which is stable, which has a small number of components, and which requires minimum package space.

Example embodiments may provide a self-supporting suspension device in which shelves, wire baskets, clothes racks, trouser hangers and the like can be fastened in an easy and replaceable/rearrangeable manner.

Example embodiments may provide a self-supporting suspension device, in which both sides can be used to suspend shelves, wire baskets, etc., which are easily accessible at the same time.

Example embodiments may provide a self-supporting suspension device in which each column comprises at least two mutually parallel flanges which are interconnected by at least one web, the inner distance between the flanges corresponding to the thickness of the foot, and that the foot has a slot at one of its ends, into which slot the column is adapted to be inserted with its web, the flanges straddling the foot in a clamping manner.

Example embodiments may provide methods for assembling the self-supporting suspension device.

The above and other features of the example embodiments including various and novel details of construction and combination of parts will be more particularly described with reference to the accompanying drawings. It will be understood that the particular self-supporting suspension device embodying the invention is shown by way of illustration only and not as a limitation of the invention. The principles and features of this invention may be employed in varied and numerous embodiments without departing from the spirit and scope of the invention.

BRIEF DESCRIPTION OF THE DRAWINGS

Example embodiments of the invention will become more fully understood from the detailed description below and the accompanying drawings.

DESCRIPTION OF EXAMPLE, NON-LIMITING EMBODIMENTS

Figure 1:
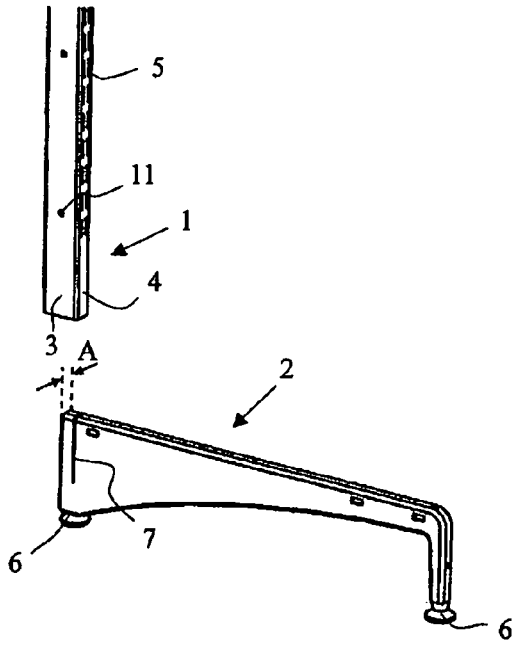
FIG. 1 is an exploded perspective view of a column and a foot included in an example embodiment of the self-supporting suspension device.
Figure 16:
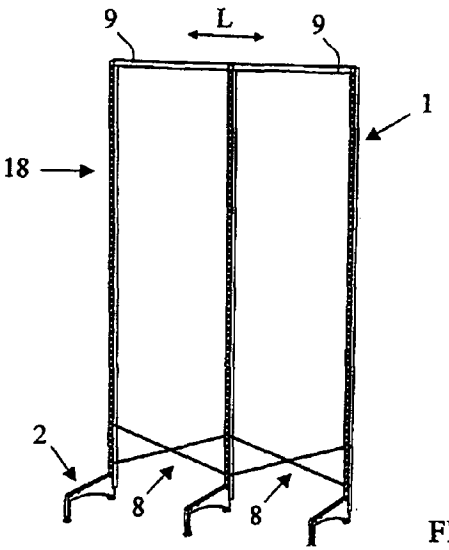

With reference first to FIGS. 1 and 16, which show components in an embodiment of a self-supporting suspension device according to the invention and the device in an assembled state, respectively, the suspension device comprises at least two columns 1 and the same number of feet 2.

Figure 3:
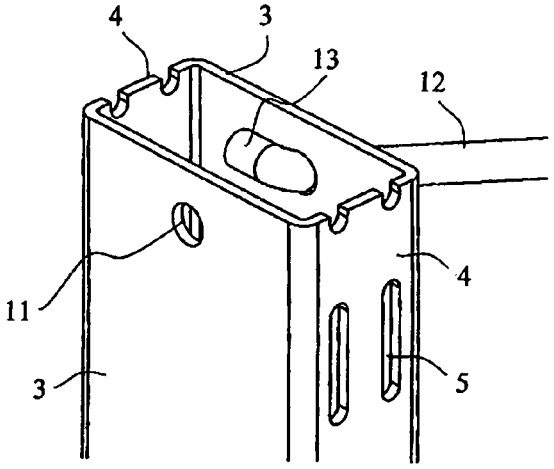
FIG. 3 is a perspective view of the bar in FIG. 2 when mounted on a column according to FIG. 1.
Figure 19:
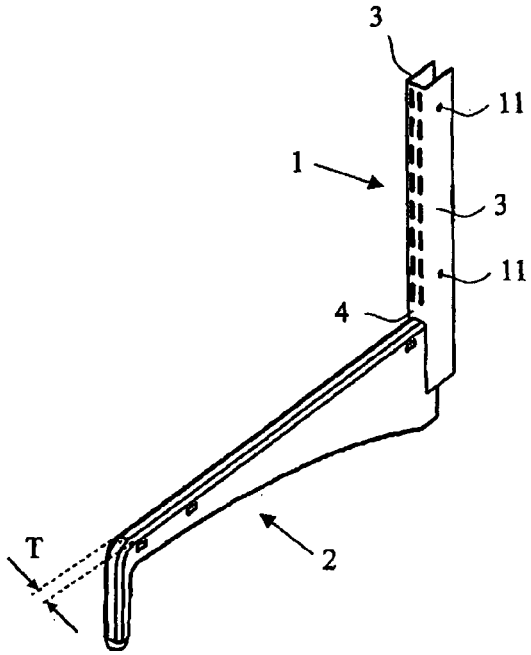
FIGS. 19 and 20 illustrate alternative example embodiments of columns that may be implemented in the suspension device.
Figure 20:
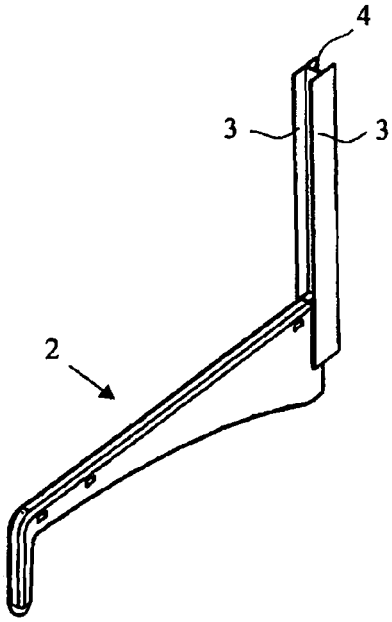

In this embodiment, the columns 1 are a hollow rail or profile with rectangular cross-section having two mutually parallel flanges 3 and two mutually parallel webs 4, cf. FIG. 3. The webs 4 of this embodiment are provided with slots or grooves 5 which are arranged in pairs and from which shelves, baskets, clothes racks or the like can be suspended, either directly or via brackets, see for instance the Elfa leaflet "Planerings-och produktguide". The columns 1 can also be formed as a U-profile, and for instance look like Elfa's carrier rail in said leaflet and as shown in FIG. 19. They can also have an H-profile as shown in FIG. 20. It is, however, necessary for the columns 1 to have at least one web 4 and a pair of parallel flanges 3, for reasons which will become clear below.

The feet 2 have the form of an elongate element, preferably in the form of a hollow sheet-metal part with an adjusting screw 6 at each end to obtain exact vertical alignment of the associated column, as will be evident from the reading of the description part. It is also possible to use only one adjusting screw, see FIG. 19, or a foot of optional design suitable to this end. The foot 2 has a non-negligible thickness T in the transverse direction, see FIG. 19. Furthermore, the foot has a slot 7 at one of its ends, which is oriented perpendicularly to the longitudinal axis of the foot and extends from the upper side of the foot towards, but not all the way to, its underside. The distance A between the slot 7 and the end is preferably substantially half the inner distance between the webs 4 of the column 1 for reasons that will appear from the text referring to FIG. 18. Furthermore, the inner distance between the flanges 3 substantially corresponds to the thickness T of the foot 2. This is because the column 1, when mounted on the foot 2, should firmly and fixedly straddle the foot so that they together function as a rigid unit, which will be explained in more detail in connection with the presentation of the assembling method.

The self-supporting suspension device according to the invention also comprises a stabilisation element 8 in order to make the assembled suspension device torsionally rigid in the longitudinal direction (in a plane at right angles to the feet of the assembled suspension device), as indicated by the two-way arrow L in FIG. 16 and as known from the sets of storage shelves mentioned by way of introduction. Different types of stabilisation elements are shown in FIGS. 8, 21-23, 25-29 and will be discussed in more detail in the text referring to these Figures.

Figure 9:
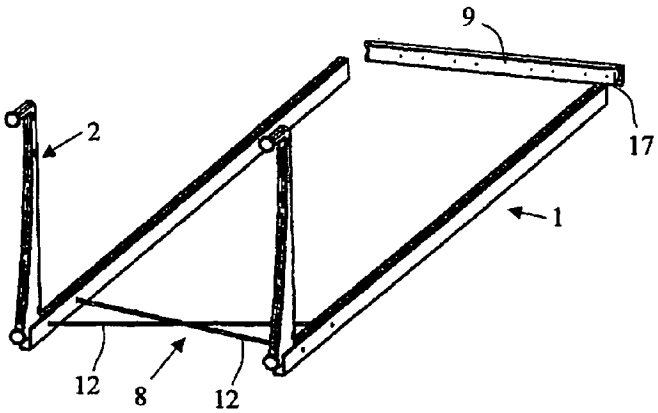
Figure 18:
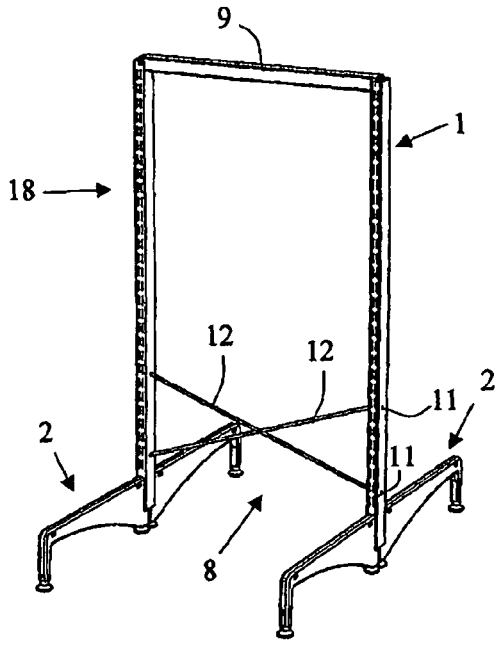
Figure 24:
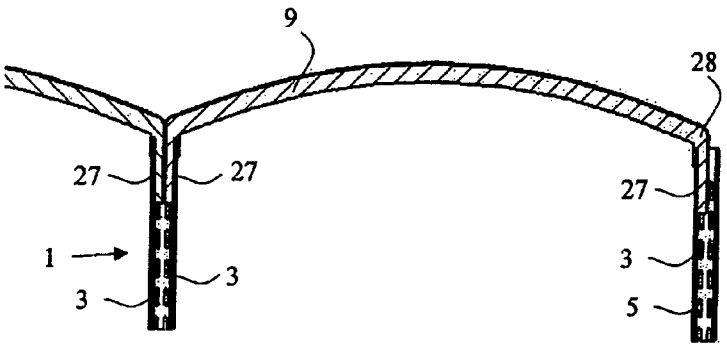
FIG. 24 is a sectional view of an alternative example embodiment of a locking beam.

Finally, the self-supporting suspension device according to the invention also comprises, in some embodiments, a locking beam 9, see FIGS. 9, 18 and 24, whose function will also be presented in connection with these Figures.

Reference is now made to FIGS. 1 and 5-11 which illustrate the different steps of assembling a section of an embodiment of a self-supporting suspension device according to the invention. First, two columns 1 are inserted in the slot 7 in their respective feet 2 so that the lowermost end of the web 4 abuts the lowermost portion of the slot and the flanges 3 are press fit on the end of the foot over the distance A, see FIGS. 1 and 5.

Figure 2:
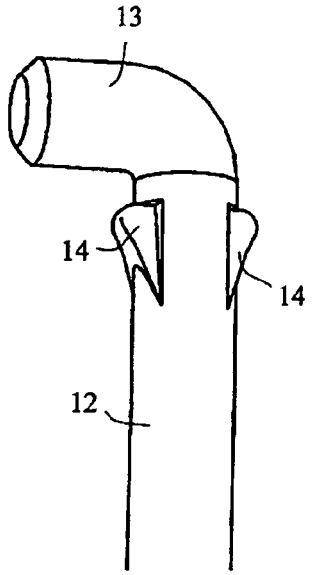
FIG. 2 is an enlarged partial view of the end of a bar which forms a stabilisation element in the suspension device.

Subsequently, said parts are placed as a unit on a support or a substructure, preferably a floor, the feet 2 being directed away from each other. In this embodiment, the flanges 3 of the columns 1 are, in their lower portion (in the upright position of the suspension device), provided with a pair of spaced-apart through holes or bores 11, in which the stabilisation element 8 is fastened. In this embodiment, the stabilisation element 8 has the form of two bars 12 which, at their two ends, comprise a portion 13 of the bar that is bent substantially at right angles to the longitudinal axis of the bar, see FIG. 2. At a distance from this portion 13, a lug 14 is formed on the bar, and this distance substantially corresponds to the thickness of the flanges 3.

Figure 8:
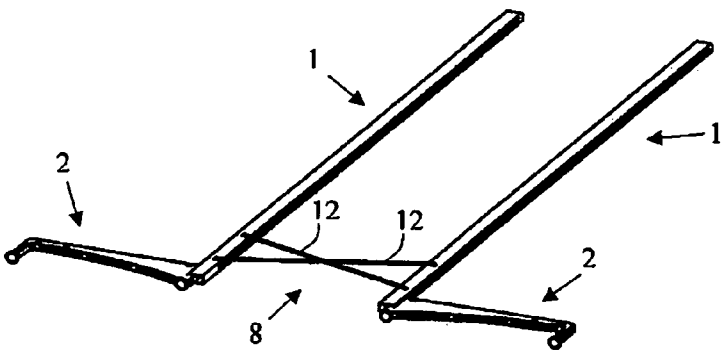
Figure 5:
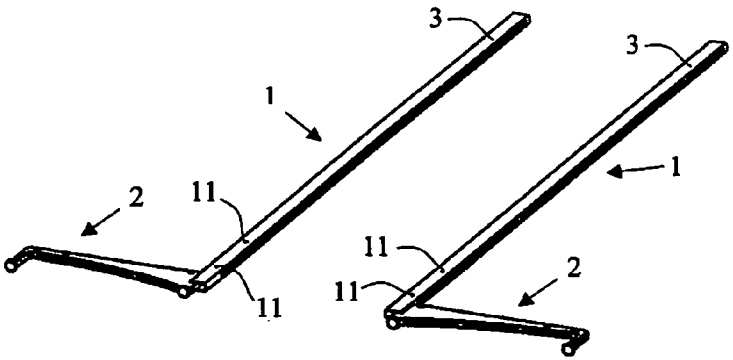
Figure 7:
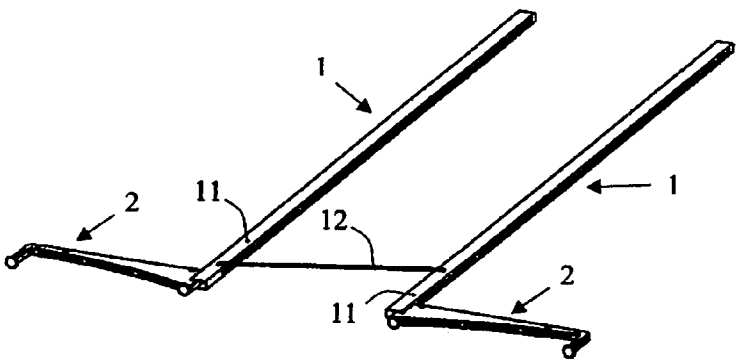

The first bent portion 13 of one of the bars 12 is inserted into the lower hole 11 of the column 1, and the second bent portion 13 of the bar 12 is inserted into the upper hole 11 of the second column and vice versa, so that the bars 12 cross each other as illustrated in FIG. 8.

In the next step, the feet 2 are turned towards each other so at to become substantially parallel (and perpendicular to the floor), see FIG. 9. The bent portion 13 and the lug 14 of the bars 12 then fix the bars on the flanges 3 so as to guarantee the mutual distance between the columns 1 as well as their parallelism, see FIG. 3.

Figure 4:
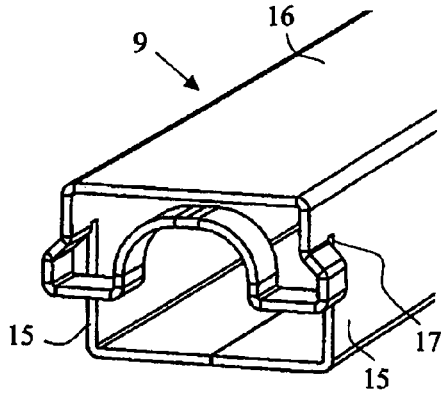
FIG. 4 is a perspective view of the end portion of a locking beam included in some example embodiments of the suspension device.
Figure 6:
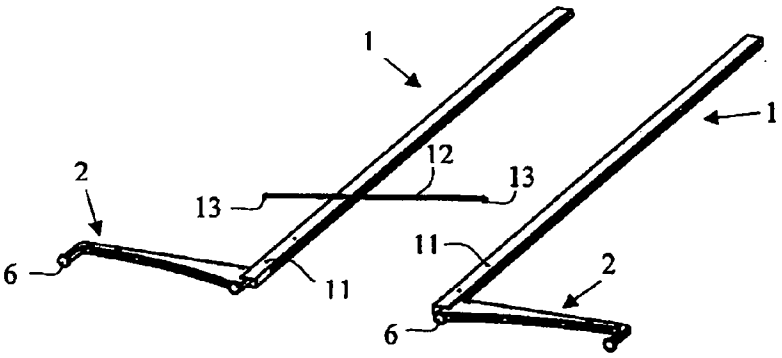
FIGS. 5-11 illustrate an example method of assembling a section of a self-supporting suspension device.
Figure 10:
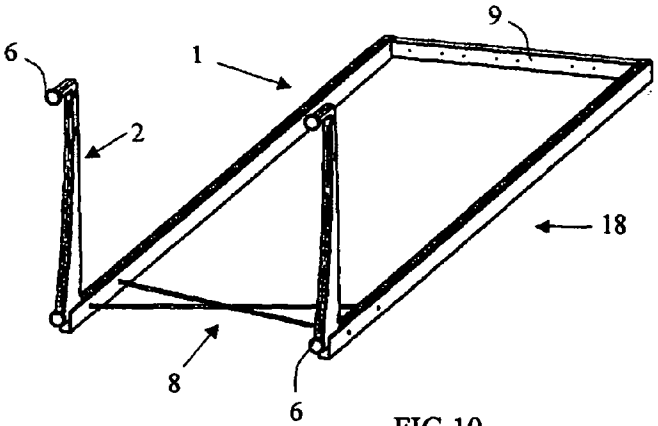

To ensure that the feet 2 remain parallel and that the assembled section will be a firm and stable unit (to prevent the columns from being turned), a locking beam 9 is arranged on the upper end of the columns, that is, their end opposite the end inserted in the foot 2, cf. FIG. 10. In this embodiment, the locking beam 9 is preferably an elongate profile which comprises two flange portions 15 and at least one web portion 16, see FIG. 4. At its ends, the locking beam 9 has a slot formation 17, whose width corresponds to the thickness of the flange 3 of the column. The locking beam is thus slipped on to the upper ends of the two columns 1, the opposite flanges 3 of the columns being inserted into the slot formations 17, which is most clearly seen in FIGS. 11 and 18.

Figure 11:
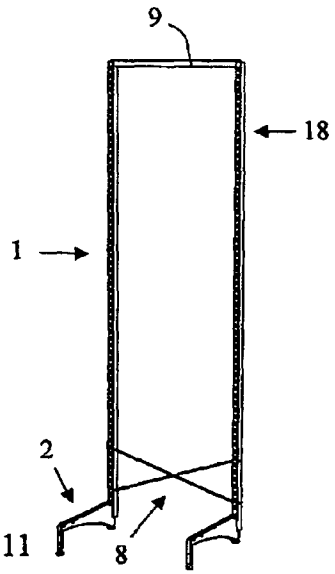
Figure 14:
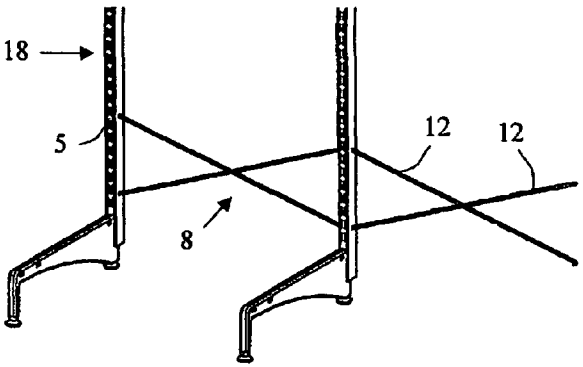

Finally, the assembled section 18 is raised and aligned by means of the adjusting screws 6 so that the columns will have an exact vertical orientation, if desired, see FIG. 11.

Figure 12:
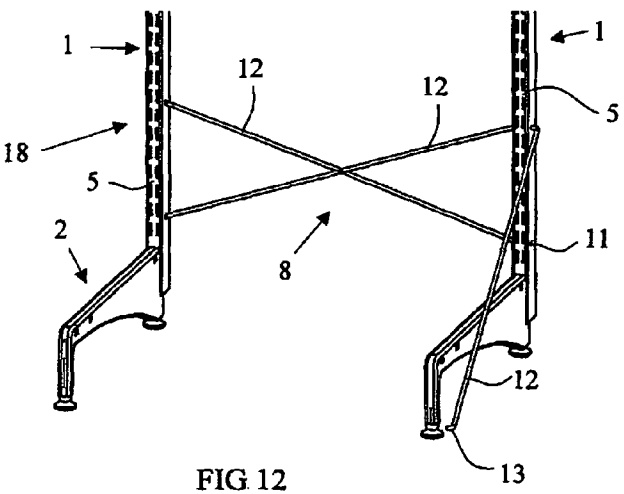
FIGS. 12-16 illustrate an example method of assembling an additional section to the section of the suspension device shown in FIG. 11.
Figure 13:
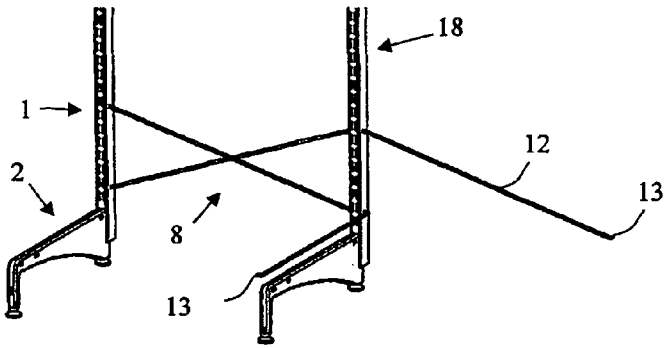

When it is desirable to add sections to the above self-supporting suspension device, the bent portions 13 of two bars 12 are inserted into the two holes or bores 11 of one of the columns which are located opposite the above-mentioned holes or bores 11, see FIGS. 12 and 13. If the previously assembled section 18, cf. FIG. 11, is placed adjacent a wall, the bent portions of the bars are inserted into the respective holes 11 with the bars 12 oriented parallel to and directed in the same direction as the foot 2 of the column in question, in contrast to the situation when the first section 18 was assembled with the bars oriented opposite to the direction of the foot, see FIG. 6. Subsequently, the crossed bars are turned so as to be located substantially in the same plane as the previously assembled bars.

Figure 15:
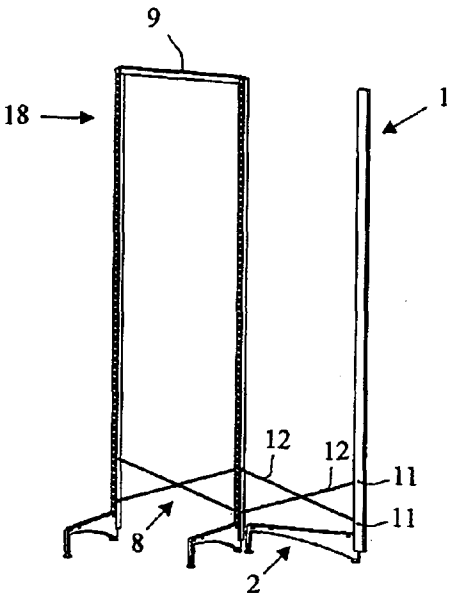

A column 1 mounted on a foot 2 according to that stated above is placed beside the already assembled section 18 with its foot directed towards the same and the bent portions on the free ends of the two crossed bars are inserted in the associated above-mentioned holes or bores in the flange 3 of the column, see FIG. 15. The foot is then turned together with the column away from the already assembled section 18 so as to become parallel to and directed in the same direction as the other feet. Finally, the column is fixed by a locking beam 9 as described in connection with FIGS. 4 and 9-10.

If additional sections are desired in the suspension device, the above procedure is repeated.

Figure 17:
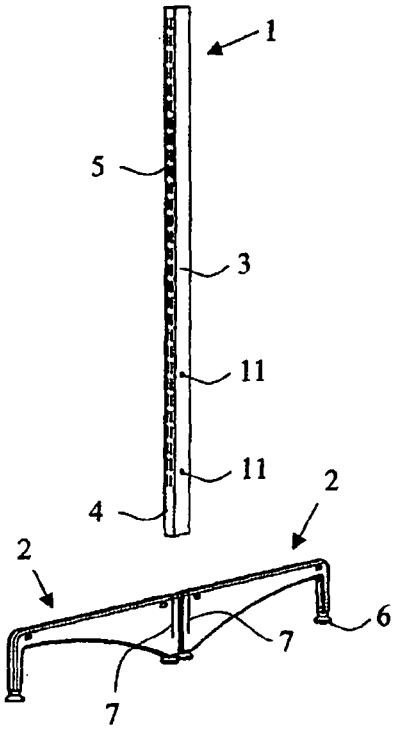
FIGS. 17 and 18 illustrate another example method of assembling a section of a self-supporting suspension device.

In the above-described embodiment of the self-supporting suspension device according to the invention, each column only has one foot. If the suspension device is intended to be placed at a distance from a wall, for instance as a room divider or with the purpose of using both sides of the suspension device in a safe manner, it is advantageous to use two feet for each column. In that case, a profile with a closed section is used, that is, two flanges 3 and two webs 4, cf. FIG. 3. As already mentioned in connection with FIG. 1, the distance A between the slot 7 of the foot and its end nearest to the slot substantially corresponds to half the inner distance between the webs 4 of the column. The two feet 2 are placed with said ends adjacent to each other and directed in opposite directions. The column 1 is inserted into the slots 7 and presses the ends of the feet towards each other, as illustrated in FIGS. 17 and 18, which results in a firm and rigid column-foot unit. If two feet are used for each column instead of one foot, the same assembling method is used as described above in connection with FIGS. 5-16.

Figure 26:
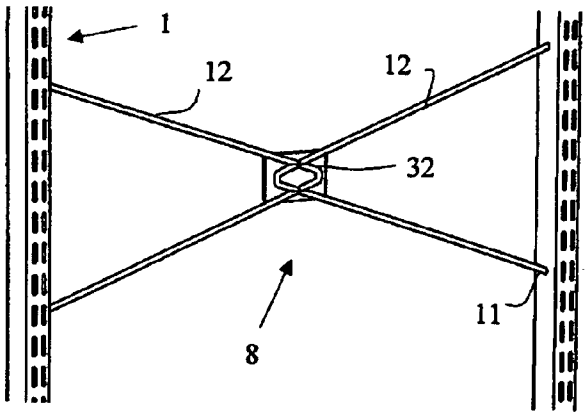
FIGS. 25-27 illustrate alternative example embodiments of the stabilisation element shown in FIGS. 6-16 and 18.
Figure 27:
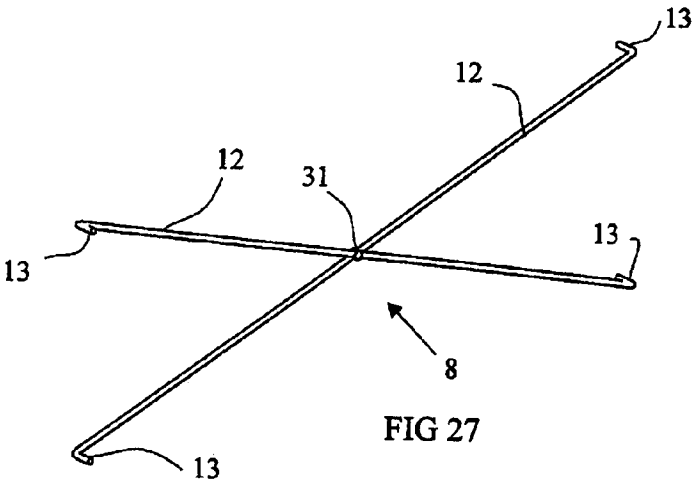
Figure 25:
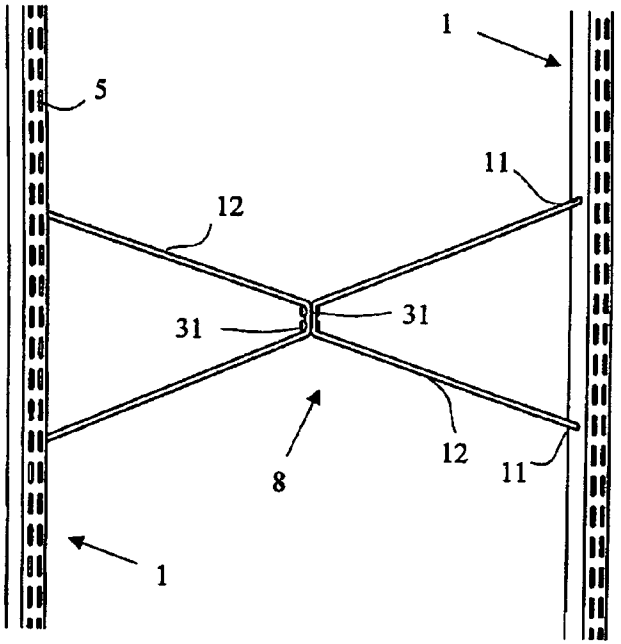

In the above embodiments of a suspension device according to the invention, the stabilisation element 8 is presented as two separate crossed bars which are fastened in the adjacent columns. They can also be formed as a unit, i.e. the bars 12 can be interconnected before they are mounted on the columns 1. FIG. 27 thus shows the bars 12 as pivotally connected to each other by a through bolt or rivet joint 31 at the respective centre portions of the bars. As an alternative embodiment, it is also possible to bend each bar into essentially V-shape and interconnect the bars 12 by one or two bolt or rivet joints 31, as exemplified in FIG. 25. A variant thereof is shown in FIG. 26, in which the bars 12 bent into V-shape are interconnected in a torsionally rigid manner by a connecting plate 32, to which they are attached, for instance, by welding or soldering.

Figure 21:
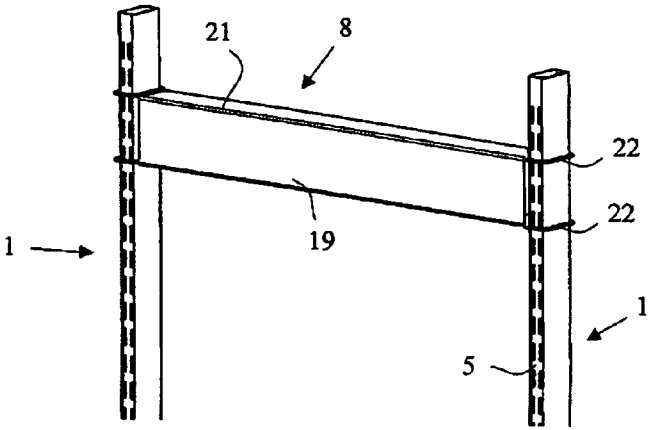

The stabilisation element 8 can also have other embodiments, among which one is illustrated in FIG. 21. The stabilisation element 8 can have a design similar to that of the locking beam 9, that is, a profile comprising two flange portions 19 (of which only one is shown in FIG. 21) and at least one web portion 21. From its two ends, a pair of spaced-apart closed or not closed clamps 22 project (only closed clamps are shown in the Figure) which have a contour corresponding to the cross-section of the columns, in FIG. 21 rectangular. Owing to the torsional rigidity of this stabilisation element, it is sufficient to slip the clamps 22 on to each column 1 to obtain the desired stability of the suspension device, that is, there is no need for a locking beam. Instead of the clamps 22, a through hole with the same contour as the cross-section of the columns can be made in the web portion/web portions 21 in the vicinity of the ends of the stabilisation element 8, into which the columns are inserted (not shown).

Using the above-mentioned stabilisation element 8, the assembly of the suspension device comprises fewer steps. After the insertion of one end of the columns into the slot of the respective feet (cf. FIG. 5), the columns are placed on the above-mentioned substructure or support in a manner such that the feet are substantially at right angles thereto. Then the columns are passed into the clamps 22 or the through holes, after which the ready-assembled suspension device is raised to vertical position.

Figure 22:
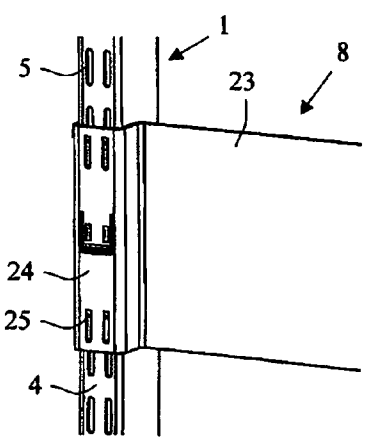
FIGS. 21, 22 and 23 illustrate example variants of stabilisation elements that may be implemented in embodiments of the suspension device.

FIG. 22 illustrates a further embodiment of the stabilisation element 8. In this embodiment, the stabilisation element comprises a relatively wide sheet-metal plate 23, which at each end has a portion 24 bent into U-shape. The shape of this portion is congruent with that of the column and tightly partially surrounds the respective columns. The bent portion is further provided with inwardly directed hook-shaped elements 25 for locking engagement with the slots or grooves 5 of the columns.

Figure 23:
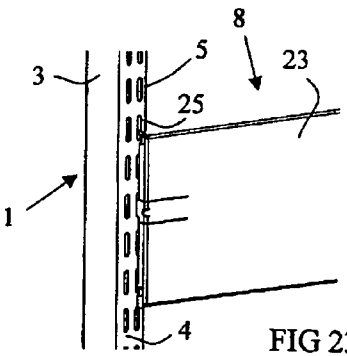

FIG. 23 illustrates an alternative design of the stabilisation element in FIG. 22. This embodiment of the stabilisation element 8 differs from the stabilisation element in FIG. 22 in that the sheet-metal plate 23 does not have a U-shaped portion at its ends but a portion 26 which is bent at right angles to the sheet-metal plate and which ends with hook-shaped elements 25 for engagement with the slots or grooves 5 in the columns 1.

The assembly of the suspension device using the stabilisation element 8 according to FIGS. 22 and 23 is preferably performed in a manner similar to that discussed in connection with FIG. 21, which is obvious for a person skilled in the art.

Figure 29:
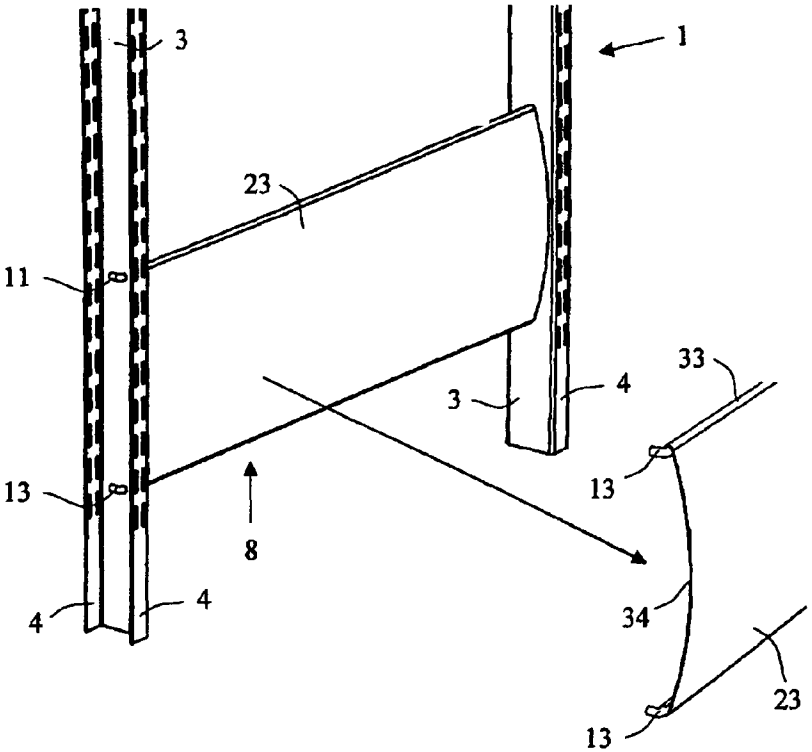
FIGS. 28-29 illustrate alternative example embodiments of the stabilisation element shown in FIGS. 22-23.
Figure 28:
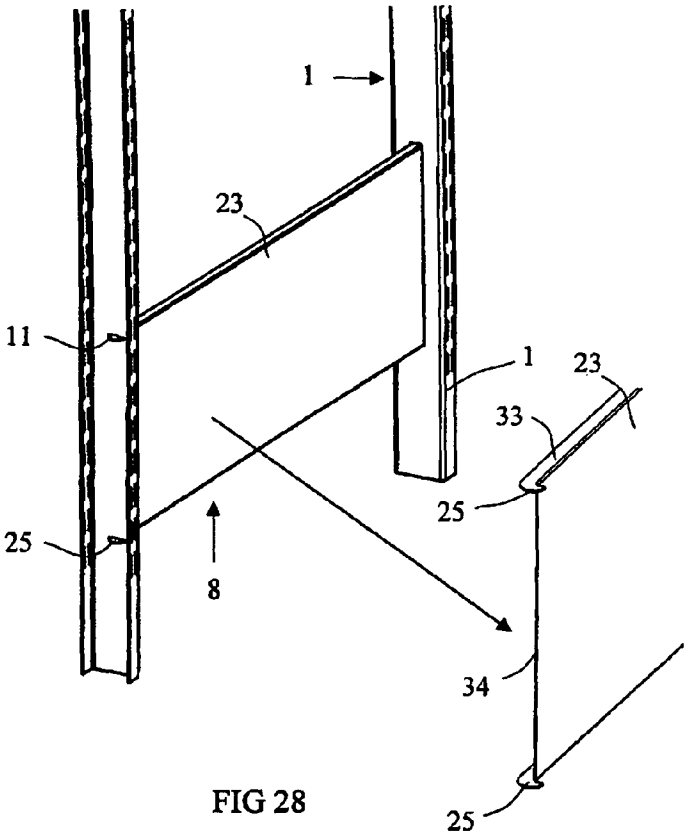

FIGS. 28 and 29 illustrate alternative embodiments of the stabilisation element 8 shown in FIGS. 22 and 23. To better illustrate the fastening of the stabilisation element to the columns, the left columns in FIGS. 28 and 29 are shown in longitudinal section through the two webs 4 of the columns 1. In these embodiments, the stabilisation element 8 comprises a flat (FIG. 28) or curved (FIG. 29) plate 23 made of sheet metal or some other suitable material. Instead of being fastened in the slots or grooves 5 of the columns 1, use is made of the holes or bores 11 shown in FIGS. 5-18. A pair of spaced-apart hook-shaped elements 25 (as shown in detail view in FIG. 28) or bent bar portions 13 (as shown in detail view in FIG. 29) project from each end of the plate 23. The hook-shaped elements 25 and the bent bar portions 13, respectively, are preferably arranged at the ends of a pair of bars 33 with rectangular or circular cross-section, which are fastened at the top and lower parts of the plate 23 (in its mounted state). The two end portions 34 of the plate function as the lug means 14 illustrated in FIG. 2.

The stabilisation elements 8 according to FIGS. 25-29 are assembled in the same way as described in FIGS. 6-16 and 18, and in particular in FIGS. 8-9 and 14-16, which is obvious to a person skilled in the art.

FIG. 24 is a cross-sectional view of an alternative embodiment of the locking beam 9. The locking beam is here arcuate but it can, of course, have some other shape and, for instance, be straight with angled end portions 28. In this embodiment, the ends of the locking beam 9 are provided with projecting tongues or cut-in portions 27, the thickness of which substantially corresponds to half the inner distance between the flanges 3 of the columns and the width of which substantially corresponds to the distance between the webs 4 of the columns. Owing to this, the two tongues 27 of two locking beams 9 can be inserted in form-fit manner into the upper end of the same column and prevent the column from being turned.

Numerous and varied example embodiments of the suspension device have been described above. It will be readily apparent to those skilled in the art that the various features presented in the different Figures may be combined in a number of ways and still fall within the spirit and scope of the inventive idea.

The invention as defined by the appended claims, is thus not limited to the example embodiments described above and shown in the drawings. The principles and features of this invention may be employed in varied and numerous embodiments without departing from the spirit and scope of the invention as defined by the appended claims.

The invention claimed is:

1. A self-supporting suspension stand device for suspending an object at least two columns, which in a raised position are substantially vertically oriented;

a foot corresponding to each column, the foot being an elongate element which, when assembled to the corresponding column, is substantially at right angles to a longitudinal direction of the corresponding column; and a stabilization element, which is fastenable to the columns to firmly interconnect them in a plane that is substantially at right angles to the feet;

wherein each column has at least two mutually parallel flanges that are interconnected by at least one web;

wherein an inner distance between the flanges corresponds to the thickness of the foot;

wherein the foot has a slot, the foot and slot being unitary, into which the web of the column is insertable, such that the flanges straddle the foot in a clamping manner, and wherein each of the columns has slots or grooves arranged in pairs in the web of the column in the longitudinal direction of the column.

2. The self-supporting suspension stand device as claimed in claim 1, wherein each of the columns includes two mutually parallel webs.

3. The self-supporting suspension stand device as claimed in claim 2, wherein the two webs of each column are insertable into respective slots of a pair of feet positioned opposite each other.

4. The self-supporting suspension stand device as claimed in claim 1, wherein the stabilization element has two ends with a pair of spaced-apart clamps to receive the columns.

5. The self-supporting suspension stand device as claimed in claim 1, wherein each of the columns has a pair of through holes in each of the two flanges, the through holes being spaced-apart in the longitudinal direction of the column;

wherein the stabilization element includes a pair of bars, each of the bars having two ends with a portion that is bent substantially at right angles to a longitudinal axis of the bar, and a lug spaced apart from the portion a distance that corresponds to the thickness of the flange; and wherein the bars are insertable into the through holes so as to cross each other between the columns.

6. A method for assembling the self-supporting suspension stand device as claimed in claim 5, comprising:

inserting one end of each column into the slot of a respective foot;

placing the columns on a support so that the feet are oriented in opposite directions;

passing the bent portions of the two bars into the through holes in the flanges of the columns with the bars crossing each other;

turning the feet towards each other so that they are substantially mutually parallel;

arranging a locking beam at the free end of the columns; and raising the assembled suspension device to a vertical position.

7. The self-supporting suspension stand device as claimed in claim 1, further comprising:

a locking beam having two ends with a slot formation to be mounted on mutually facing flanges of the columns, at an end of the columns opposite an end to be fastened to the feet.

8. A method for assembling the self-supporting suspension stand device as claimed in claim 1, comprising:

inserting one end of each column into the slot of a respective foot;

placing the columns on a support so that the feet are substantially at right angles to the support;

mounting the stabilization element to the columns;

raising the suspension device to a vertical position; and arranging a locking beam at a free end of the columns.

9. The self-supporting suspension stand device as claimed in claim 1, wherein the slot is in an uppermost surface of the foot.

* * * * *